US006874612B1

(12) United States Patent
Uland

(10) Patent No.: US 6,874,612 B1
(45) Date of Patent: Apr. 5, 2005

(54) MEDIA DISPENSER FOR VENDING MACHINES

(75) Inventor: David M. Uland, Granville, OH (US)

(73) Assignee: Wisconsin Label Corporation, Algoma, WI (US)

( * ) Notice: Subject to any disclaimer, the term of this patent is extended or adjusted under 35 U.S.C. 154(b) by 86 days.

(21) Appl. No.: 10/310,580

(22) Filed: Dec. 5, 2002

(51) Int. Cl.[7] ..... G07F 7/00
(52) U.S. Cl. ..... 194/212; 194/205; 186/52
(58) Field of Search ..... 194/212, 205, 194/302; 186/52, 55, 56; 221/2, 8, 26; 222/23

(56) References Cited

U.S. PATENT DOCUMENTS

| | | | | | |
|---|---|---|---|---|---|
| 4,454,670 | A | * | 6/1984 | Bachmann et al. | 40/584 |
| 4,717,043 | A | | 1/1988 | Groover et al. | 221/7 |
| 4,896,791 | A | | 1/1990 | Smith | 221/7 |
| 4,928,133 | A | * | 5/1990 | Fulton | 347/153 |
| 5,090,589 | A | | 2/1992 | Brandes et al. | 221/2 |
| 5,290,033 | A | | 3/1994 | Bittner et al. | 273/138 A |
| RE34,915 | E | | 4/1995 | Nichtberger et al. | 364/401 |
| 5,620,079 | A | * | 4/1997 | Molbak | 194/217 |
| 5,625,562 | A | | 4/1997 | Veeneman et al. | 364/479.05 |
| 5,769,269 | A | | 6/1998 | Peters | 221/7 |
| 5,845,259 | A | | 12/1998 | West et al. | 708/14 |
| 5,924,596 | A | | 7/1999 | Kaufman | 221/312 C |
| 5,956,876 | A | | 9/1999 | Burdette et al. | 40/611 |
| 6,076,068 | A | | 6/2000 | DeLapa et al. | 705/14 |
| 6,076,069 | A | | 6/2000 | Laor | 705/14 |
| 6,105,002 | A | | 8/2000 | Powell | 705/14 |
| 6,151,587 | A | | 11/2000 | Matthias | 705/14 |
| 6,161,059 | A | | 12/2000 | Tedesco et al. | 700/232 |
| 6,243,687 | B1 | | 6/2001 | Powell | 705/14 |
| 6,536,663 | B1 | * | 3/2003 | Lozier et al. | 235/379 |
| 6,696,127 | B1 | * | 2/2004 | Mitchell, Jr. | 428/43 |

* cited by examiner

*Primary Examiner*—Donald P. Walsh
*Assistant Examiner*—Mark J Beauchaine
(74) *Attorney, Agent, or Firm*—Thomas B. Ryan; Brian B. Shaw, Esq.; Harter, Secrest & Emery LLP

(57) ABSTRACT

Variably printed media units from an uninterrupted supply are dispensed from vending machines in association with the dispensing of products or services from the machines. The media units, which can take a variety of forms including coupons, vouchers, tickets, collector cards, game pieces, pull tabs, stickers, and web decoders, promote the sales of products or services from the vending machines or other preferably local sales outlets.

50 Claims, 3 Drawing Sheets

MEDIA DISPENSER FOR VENDING MACHINES

TECHNICAL FIELD

The invention relates to promoting the sale of products or services from vending machines including kiosks by dispensing printed media such as coupons or tickets in association with the sale of the products or services from the machines.

BACKGROUND

Some vending machines have been adapted to dispense coupons or tickets in association with the delivery of products from the machines. The coupons or tickets are stored in the machine in sheet form and, accompanying the delivery of the products, are transported from a storage stack through a slot in the machine face.

Although the coupons or tickets dispensed from the machines have been shown to increase sales from the machines, the dispensers have lacked reliability. The individual sheets can become jammed and block further operation of the dispenser until the vending machine is next serviced.

On-demand printing of coupons has also been added to vending machines to print coupons in electronic storage. Continuous roll paper has been used as a paper supply for on-demand printing. Although less susceptible to jamming, a cutting operation required for separating the individually printed coupons raises other reliability issues. In addition to the printer itself, which requires servicing, the cutter adds another moving component subject to breakdown. Electronic transfer of coupon information adds more complexity so that, overall, the servicing requirements for on-demand printing in vending machines have been excessive.

While controlling multiple vending machines remotely within a common network is technically feasible, the current processing capability of vending machines is limited and network hookups would be difficult in many locations and expensive to maintain. Generally, the vending machine owners are not also the owners of the sites on which the machines are placed.

SUMMARY OF INVENTION

Sales of products or services from vending machines can be increased by reliably dispensing variably printed media in association with the delivery of the products or services from the machines. The ability to reliably dispense variably printed media in association with the delivery of products or services also enhances the value of the vending machine to the property owner. The variably printed media can take a variety of forms including coupons, vouchers, tickets, game pieces, pull tabs, stickers, web decoders, and collector cards. Demand for the printed media can be enhanced by randomly or apparently randomly dispensing the printed media with variable content.

An exemplary vending machine arranged in accordance with my invention includes the usual features of an input interface that accepts and processes payments including cash or other forms of value (e.g., customer information) and an output interface that delivers products or services in return for the payments. In addition, my invention provides for an uninterrupted supply of media arranged in a succession of units separated by zones of weakness. A media dispenser dispenses the media units in association with the delivery of the products or services. A driver within the media dispenser responds to a registrable feature of the media units and advances the media units to a dispensing position at which the media units can be manually withdrawn from the vending machine by bursting the zones of weakness.

Preferably, the succession of media units are preprinted in a variable manner so that printed contents of a plurality of adjacent media units differ from each other. For example, the printed contents of the succession of media units can vary from each other in an apparent random fashion.

The printed contents of the media units can include promotional information, such as media units that are redeemable for products or services delivered by the vending machine or elsewhere. Alternatively, the media units can have intrinsic value. For example, the printed contents of the media units can share a common cultural theme promoted for purposes of collection.

The succession of media units is preferably arranged in a fan-folded stack whose folds occur at the zones of weakness. The succession of media units joined together by the zones of weakness avoid the jamming problems of sheet feeding. The fan folding of the media units avoids the curling effect of dispensing the media from a roll.

The media dispenser also preferably performs a braking function for gripping the succession of media units in place to prevent media units from being prematurely withdrawn from the vending machine. The driver preferably advances the media units toward the dispensing position at which a forward-most of the media units is exposed for manual withdrawal from the vending machine. However, the driver also preferably resists the further movement and withdrawal of succeeding media units from the vending machine until the next of the succeeding media units is subsequently advanced by the driver to the dispensing position. No distinct brake is required. The zones of weakness separating the media units are preferably frail enough to break before the resistance of the media dispenser driver can be overcome.

A burster bar within the media dispenser can be used to apply elevated and uneven stresses to the zones of weakness. The burster bar is itself positioned so that at the dispensing position of the media units, the zones of weakness are aligned with respect to the burster bar, which is preferably shaped to unevenly distribute stress across a width of the media units. The media units are dispensed through a slotted opening in a front face of the vending machine, and the slotted opening is positioned relative to the burster bar so that the media units are pulled against the burster bar when manually withdrawn from the vending machine.

A detector within the media dispenser can be used to detect the registrable feature of the media units. The registrable feature can incorporate a security feature that is not apparent from the visual appearance of the media units. The security feature can include a pattern of variation detectable by the detector. For example, the pattern of variation can involve an optical variation in reflectance or spectral content. The detector senses variation in infrared radiation reflected from the security feature of the media units.

A rationing counter can be used to control a ratio at which media units are dispensed in connection with the delivery of the products or services. For example, every sale can result in the dispensing of a media unit, or some constant or variable number of sales may be required before a media unit is dispensed. The ratioing counter is preferably adjustable for changing the ratio between the dispensing of the media units and the delivery of products or services. A random number generator, such as a apparent random lookup table, within the ratioing counter can provide for continuously changing the ratio. However, the continuously changing the ratio can be arranged to average to a prescribed fixed ratio so the number of media units required is more predictable.

An indicator, such as a light, audio message, or display notice, can be used for announcing appearances of the media units at the dispensing position. The announcement makes certain the purchaser is aware of the dispensed media unit and can engender associated excitement.

An exemplary method of promoting sale of products or services from a machine includes preprinting an uninterrupted supply of media so that printed contents of a plurality of adjacent media units differ from each other. Zones of weakness separate the adjacent media units. The uninterrupted supply of preprinted media is arranged within the machine as a fan-folded stack with the folds of the fan-folded stack being made along the zones of weakness. Payment is accepted for delivery of products or services from the machine. In association with the sale, the uninterrupted supply of media units is advanced from the fan-folded stack to a dispensing position at which the media units can be manually withdrawn from the machine by bursting the zones of weakness.

Preferably, the exemplary method also includes creating a range of artwork in connection with a promotion of the products or services. The media units can be preprinted from the range of artwork connected with the promotion. Preferably, the media units are preprinted in a variable manner so that the printed contents of the media units vary from each other in an apparent random fashion. Exemplary artwork includes designs suitable for coupons redeemable for products or services delivered from the machine or elsewhere. Alternatively, the exemplary artwork can have an intrinsic value, such as for purposes of collection. The preprinted artwork can also be linked to an advertising campaign remote from the machine.

The preprinting of the media units can also include preprinting a registration mark, which is detectable for identifying the dispensing position at which the media units can be manually withdrawn. A security feature can be incorporated into the registration mark, which is detectable for verifying authenticity of the uninterrupted supply of media. The security feature can involve a pattern of varying reflectance or spectral content that is not readily apparent or reproducible. The pattern can be used to uniquely identify individual media units or groups of media units.

The advancement of the uninterrupted supply of media in response to the delivery of products or services can be fixed at a given ratio or allowed to vary. For example, the ratio can be changed or allowed to continuously change. Higher valued media units can be dispensed on a less frequent basis. To add further interest, the appearance of the media units at the dispensing position can be announced in various ways, such as by lights, displays, or sounds.

DRAWINGS

DETAILED DESCRIPTION

Figure 1:
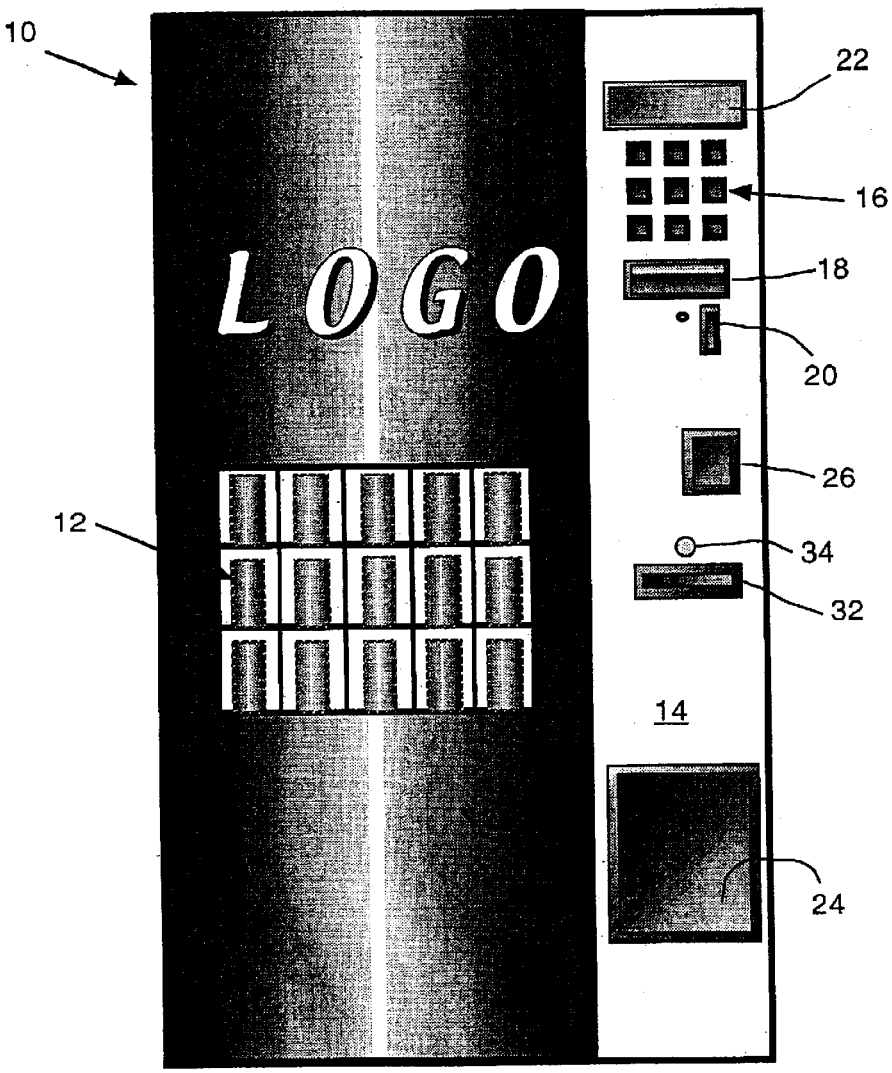
FIG. 1 is a front view of an exemplary vending machine containing a media dispenser.

An exemplary vending machine 10 for dispensing products 12 in return for payments is shown in FIG. 1. On a front face 14 of the machine 10, an array of selection buttons 16 provides for choosing among different ones of products 12 stored within the vending machine 10. Cash payments are accepted by either a bill validator 18 or a coin validator 20. Available credit or other information concerning the transactions appear on a display 22. The purchased products 12 are dispensed through a delivery port 24. Excess credit can be returned through a coin return box 26.

Figure 2:
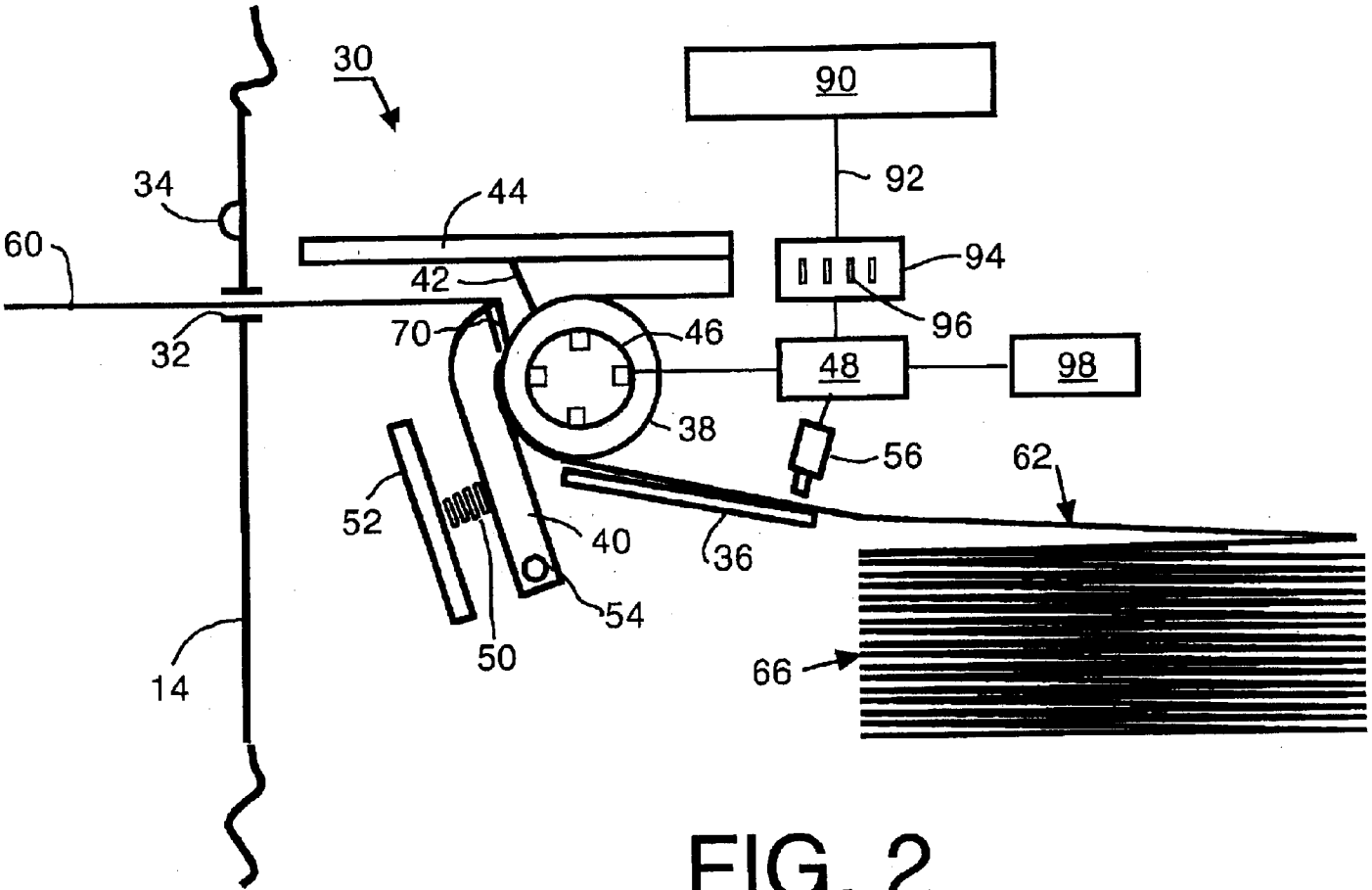
FIG. 2 is a diagram of the media dispenser showing a feed path for fan-folded media units from a stack through a slot in the vending machine.

In addition to these customary features, the vending machine 10 includes a media dispenser 30 as shown in FIG. 2 for dispensing media units 60 from an uninterrupted supply of media 62 through a slot 32 in the front face 14 of the machine 10. A light 34 above the slot 32 announces the arrival of one of the media units 60. Other types of announcements could also be made including displaying messages on the display 22, operating the machine lights, or making an audio announcement.

Figure 3:
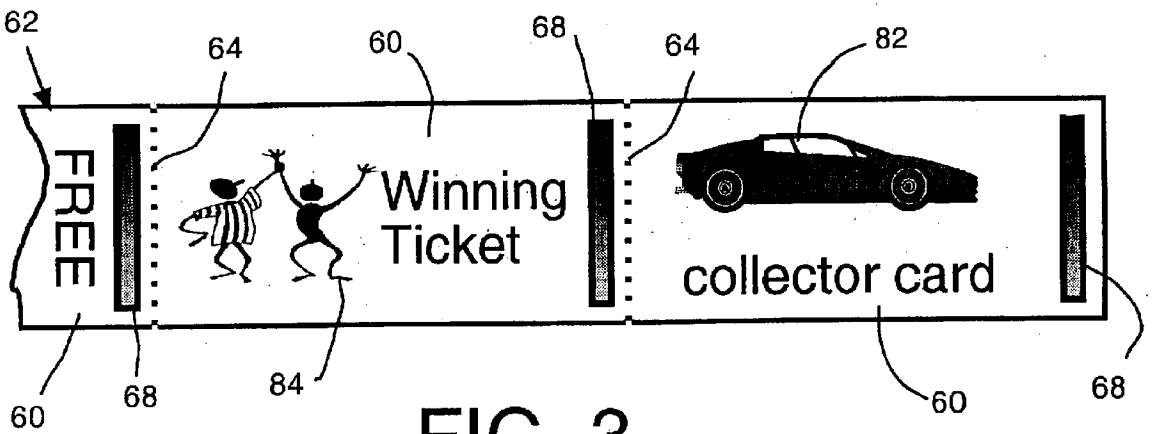
FIG. 3 shows a cut-off succession of the media units, which are variably printed and separated by lines of perforation.

As shown in FIG. 3, a succession of the media units 60 are variably printed and separated from one another by lines of perforation 64. Preferably, the lines of perforation 64 have a bursting strength of less than three pounds and more preferably less than two pounds. The lines of perforation 64 are also preferably arranged to exhibit more strength towards the outer sides of the media units 60 and less strength towards the middle of the media units 60 to resist untimely bursting during web processing while minimizing the bursting force required to extract individual media units 60 from the vending machine 10. U.S. application Ser. No. 10/037,824, entitled Differential Perforation Pattern for Dispensing Print Media, discloses perforation patterns suitable for these purposes and is hereby incorporated by reference. Creasing, thinning, indenting, and other types of weakening could be used to produce similar zones of weakness for separating the media units 60.

The uninterrupted supply of media 62 is loaded into the machine 10 as a fan-folded stack 66 as shown in FIG. 2. The alternating directional folds of the fan-folded stack 66 occur about the lines of perforation 64. A succession of media units 60 drawn from the fan-folded stack 66 is treaded through the media dispenser 30. An input guide 36 directs the media units 60 between a motor-driven roller platen 38 and a main guide 40, which provide for feeding the media units 60 through the media dispenser 30. A platen scraper guide 42 and exit guide 44 direct the media units 60 through the slot 32 in the front face 14 of the vending machine 30 to a dispensing position (shown in FIG. 2) where the media units 60 can be manually withdrawn.

The roller platen 38 in combination with the main guide 40 frictionally engages the media units 60 both to impart motion to the media units 60 when feeding is desired and to impart an active or passive braking force against the media units 60 when further feeding is no longer desired. Rotation of the roller platen 38 is imparted by a stepper motor 46 directly or through an intervening transmission under the command of logic controller 48. A compression spring 50 projecting from a support plate 52 rotates the main guide 40 about a pivot 54 into engagement that pushes the media units 60 against the roller platen 38. A normal force imparted by the spring 50 between the main guide 40 and the roller platen 38 generates a frictional force between the roller platen 38 and the media units 60. When the roller platen 38 is rotated by the stepper motor 46, the frictional force communicates motion to the media units 60. When the roller platen 38 is stopped by the stepper motor 46, the frictional force resists further movement of the media units 60.

Figure 4:
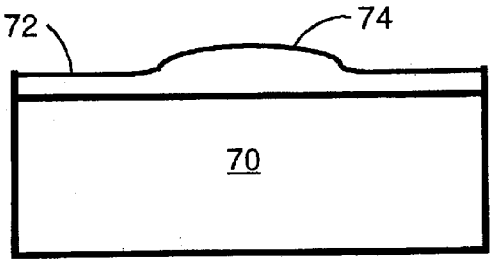
FIG. 4 shows a front view of a burster bar from the media dispenser arranged with an irregular edge.

A burster bar 70, shown also in FIG. 4, is mounted at the free end of the main guide 40 and provides an irregular edge 72 over which the media units 60 must pass before exiting the media dispenser 30 through the slot 32. The motor-driven roller platen 38 feeds the media units 60 to the dispensing position which locates one of the lines of perforation 64 in the vicinity of the burster bar 70. A detector 56 senses a registrable feature 68 of the media units 60 for determining the position of the media units 60 with respect to the burster bar 70. Information concerning the detected position of the media units 60 is passed to the logic controller 48 for operating the stepper motor 46 and advancing individual media units 60 to the dispensing position.

When the stepper motor 46 is stopped, the roller platen 38 and main guide 40, together with the stepper motor 46 and any transmission, function as a braking mechanism to prevent further movement of the succession of media units 60 from the stack 66. Although preferably de-energized at the dispensing position, the stepper motor 46 can exhibit a magnetic cogging force that resists further rotation. Higher resistance forces can be generated by energizing the stepper motor 46 in a manner that resists rotation or actively opposes detected movement of the media units 60.

At the dispensing position, the line of perforation 64 between the two forward-most media units 60 is preferably located at or slightly behind the burster bar 70 to assure that the irregular edge 72 of the burster bar 70 engages the so-registered line of perforation 64 between the two forward-most media units 60 before any of the media units 60 are allowed to be withdrawn from the machine 10. As shown in FIG. 2, the media units 60 are bent around the burster bar 70 so that a manual force imparted for withdrawing the media units 60 through the slot 32 pulls the registered line of perforation 64 against the irregular edge 72 of the burster bar 70. The irregular edge 72 and particularly its center hump 74, as shown in FIG. 4, differentially stresses the registered line of perforation 64 to initiate a bursting sequence starting at the weaker center of the line 64 and proceeding towards both ends.

The registrable feature 68 is shown in FIG. 3 as a printed bar in a transverse orientation, but other patterns and orientations as well as other physical features of the media units can be used for purposes of registration. Preferably, the registered feature 68 incorporates a security feature for verifying authenticity of the media units 60 or for monitoring their dispensing. In FIG. 3, the registered feature 68 is depicted as a gray-scale variation. However, the security feature is preferably not readily noticeable or duplicable. For example, the security feature could exhibit an optical variation in reflectance or spectral content of infrared radiation, which can be accomplished by varying the carbon content of printing ink.

An infrared sensor could be used as the detector 56 or in conjunction with the detector 56 for sensing variation in infrared radiation reflected from the incorporated security feature. If the correct security feature is not detected, the motor-driven roller platen 38 can be braked or logically disengaged to avoid dispensing any of the media. The security feature, which could be separate from the registrable feature, discourages use counterfeit media, rogue promotions, and other unauthorized substitutions. Although the registered feature 68 is shown in a transverse orientation, a simplified detector 56 can be used to monitor variations oriented in the direction of movement of the media units 60.

The uninterrupted supply of media 62 is preferably preprinted in a variable manner as shown in FIG. 3 so that the printed contents of adjacent media units 60 differ from each other. More preferably, the media units 60 vary from each other in an apparently random fashion. The printed contents of the media units can include a wide variety of promotional information including coupon offers for products or services delivered by the vending machine 10 or available elsewhere, rebate offers, and tickets of admission or play, as well as contents having intrinsic value such as collector cards. For purposes of collection, the printed contents of at least some of the media units 60 can be arranged to share a common cultural theme. Laminated media such as game pieces, pull tabs, stickers, and web decoders can also be dispensed as individual media units through the media dispenser 30. A theme of the printed contents can also be arranged to match a promotional theme (e.g., an advertising campaign) expressed remotely of the machine. The promotional theme preferably relates to the products 12 dispensed from the vending machine 10 or to products or services sold by property owners or their clients.

One of the media units 60 in FIG. 3 is arranged as a "collector card" containing a graphic image 82 of a racecar, which is representative of a cultural theme. A variety of other racecars or other related images sharing the common cultural theme can be printed on other of the media units 60 to promote their collection. Other ideas for cultural themes are disclosed in U.S. application Ser. No. 09/829,571, entitled Theme-matching Scrip for Gaming Systems, which is hereby incorporated by reference.

Another of the media units 60 in FIG. 3 is arranged as a "Winning Ticket" containing a graphics image 84 depicting a winning scene. The "Winning Ticket" can be redeemed as a rebate or coupon by telephone, internet, mail, or a participating retail outlet.

The uninterrupted supply of variably printed media 62 is particularly suitable for targeting local promotions in the immediate or farther ranging vicinity of the vending machine 10. Such local promotions can also aid in the placement of vending machines by promoting the products, services, or business relationships of businesses responsible for such placements.

A controller 90 of the vending machine 10, which can also be used to supply power to the media dispenser 30, produces a trigger signal 92 associated with each transaction that results in the release of the product 12 to the delivery port 24. Upon reaching the logic controller 48, the trigger signal 92 can be used to dispense one of the media units 60. Generally, one of the media units 60 is dispensed in connection with each transaction of the vending machine 10. However, other ratios are possible. For example, a ratioing counter 94 (which could also be accomplished in software or hardware within the controller 90) intercepts the trigger signal 92 from the controller 90 to dispense the media units 60 at other ratios. Control of the media dispenser 30 can be programmed to accommodate different vending machine control signals.

Switches 96 on the ratioing counter 94 can be accessed to reset the ratio to a particular desired ratio or to a ratio that varies in an apparently random fashion. At a one-to-two ratio, for example, one of the media units 60 is dispensed through the slot 32 accompanying every other complete transaction, resulting in the delivery of one of the products 12. In addition, a random number generator, which can include an apparently random number lookup table, can be incorporated into the ratioing counter 94 for continuously changing the ratio between the dispensing of individual media units 60 and the delivery of the products 12. Although continuously changing, the ratio preferably averages to a fixed ratio set by the switches 96 to provide for dispensing the media units 60 on a more predictable basis for purposes of restocking. The range of ratios can also be limited to avoid ratios that result in the dispensing of media units 60 too infrequently to support incentive buying.

My preferred vending system begins with the creation and proofing of a range of artwork and constructions associated with the promotion of products or services. Particular promotions can be selected from a menu of features and quantities reflecting a range of capabilities. The uninterrupted supply of media 62 is preprinted or otherwise assembled along a web press having a succession of stations for assembling features of the selected promotions. The operations include most notably preprinting for displaying the selected artwork, such as the graphic images 82 and 84, and die cutting for forming zones of weakness separating the media units 60, such as the lines of perforation 64, but can also include operations such as coating, filling, laminating, and other die-cutting operations.

The finished media units can take the form of coupons, vouchers, tickets, collector cards, game pieces, pull tabs, release-backed sticker labels, and web decoders, as well as combinations of these media forms. Of these, the redeemable media units are preferably redeemable for the products or services dispensed from the vending machine 10 or for other locally available products or services. However, the promotions printed on the media units 60 can also be tied to more remote (e.g., national or regional) advertising campaigns.

The succession of preprinted media units 60 preferably varies so that the printed contents of adjacent media units 60 differ from each other. Even more preferably, the printed contents of the media units 60 vary from each other in an apparently random fashion. Although rotary printing presses are currently preferred for producing the variable content at low cost, digital printing can be used to provide endlessly variable content.

The uninterrupted supply of media 62 is preferably loaded into the vending machine 10 as a fan-folded stack. The folds break in alternating directions about the lines of perforation 64 so that each of the media units 60 is stacked flat against adjacent media units 60. The uninterrupted supply 62 of interconnected media units 60 increases reliability of the media dispenser 30 by reducing incidences of jamming, which are more prevalent with sheet feeders. In addition, the interconnection of the media units 60 enhances security by preventing the removal or re-ordering of the media units 60 when restocked in the machine 10.

The media dispenser 30 can be added to existing vending machines 10 (particularly modular machines) with a minimum of modifications. In most instances, both the power for operating the media dispenser 30 and the signal 92 for timing the operation of the media dispenser 30 can be obtained from the controller 90 of the vending machine 10. The ratioing counter 94 can trigger the operation of the media dispenser 30 in a fixed or variable ratio with the delivery of products (or services) from the vending machine 10.

The relative location of individual media units 60 within the media dispenser 30 is obtained by the detector 56 that detects the registrable feature 68 of the individual media units 60 and supplies this information to the logic controller 48 for controlling the operation of a motor-driven roller platen 38. Upon command of the logic controller 48, the media units 60 are advanced to the dispensing position at which one of the media units 60 projects through the slot 32 in the front face 14 of the vending machine 10.

At the dispensing position, the line of perforation 64 between the two forward-most media units 60 is aligned with the irregular edge 72 of the burster bar 70. The first of the two forward-most media units 60 projects directly through the slot 32. The second of the two forward-most media units 60 is bent to a different angular orientation behind the burster bar 70 and is gripped between the roller platen 38 and the spring-loaded main guide 40.

Manual withdrawal of the projecting first media unit 60 forces the line of perforation 64 separating the first and second media units 60 against the irregular edge 72 of the burster bar 70. The force required to burst the line of perforation 64 for withdrawing the first of the media units 60 is significantly less than the frictional force applied to the second of the media units 60 to assure that only one of the media units 60 is dispensed each time from the dispensing position. The irregular edge 72 of the burster bar cooperates with a pattern within the lines of perforation 64 to effect a bursting sequence (e.g., starting at the center and proceeding toward both sides) that can further reduce the bursting force required to manually withdraw the media units 60.

The appearance of one of the media units 60 at the dispensing position projecting through the slot 32 can be announced by the light 34 or by other machine responses, such as the associated appearance of a message in the display 22, a blinking of other machine lights, or a recorded or synthesized audio message. An odometer 98 can also be connected to the logic controller 48 for counting the number of media units 60 that are dispensed to provide inventory control and further discourage the unauthorized removal of media units 60 by restockers or others with access to the interior of the machine 10.

The incorporation of a security feature within the registration feature 68 or elsewhere on the media units 60 can be used to block use of unauthorized or counterfeit media. If a valid security code is not detected by the detector 56, further operating of the media dispenser 30 can be suspended or the event can be recorded for later action. For example, the detection of a succession of invalid codes may be required to shut down the dispenser 30 to mitigate against possibilities for misreading the security codes of individual media units 60.

Although the illustrated example of my invention is depicted with respect to a vending machine for dispensing products, similar modifications can be made to venting machines including kiosks for dispensing services. The media dispenser 30 itself is exemplary, since other known types of media dispensers can also be used for dispensing an uninterrupted supply of variably printed media units in association with the dispensing of products or services from the vending machine.

I claim:

1. A vending machine of a type that accepts payments and returns products or services comprising:

an input interface that accepts and processes payments;

an output interface that delivers products or services in return for the payments;

an uninterrupted supply of media arranged in a succession of units separated by zones of weakness;

a media dispenser that dispenses the media units in association with the delivery of the products or services; and a driver within the media dispenser responsive to a registrable feature of the media units for advancing the media units to a dispensing position at which the media units can be manually withdrawn from the vending machine by bursting the zones of weakness, wherein:

(a) the succession of media units are preprinted in a variable manner so that printed contents of a plurality of adjacent media units differ from each other, (b) the printed contents of the media units include promotional information, (c) the media units include media units that are redeemable for products or services, and (d) the redeemable media units are redeemable for the products or services delivered by the vending machine.

2. The vending machine of claim 1 in which the printed contents of a plurality of the media units has intrinsic value.

3. The vending machine of claim 2 in which the printed contents of the plurality of the media units share a common cultural theme promoted for purposes of collection.

4. The vending machine of claim 1 in which the succession of media units is arranged in a fan-folded stack.

5. The vending machine of claim 4 in which folds of the fanfolded stack occur at the zones of weakness.

6. The vending machine of claim 1 in which the driver advances the media units to the dispensing position at which one of the media units is exposed for manual withdrawal from the vending machine and a succeeding media unit remains engaged by the driver to prevent an accompanying withdrawal of the succeeding media unit from the vending machine until the succeeding media unit is subsequently advanced to the dispensing position.

7. The vending machine of claim 6 in which the media dispenser includes a burster bar, and the dispensing position aligns the zones of weakness with the burster bar.

8. The vending machine of claim 7 further comprising a slotted opening in the vending machine through which the media units are dispensed, and the slotted opening is positioned relative to the burster bar so that the media units are pulled against the burster bar when manually withdrawn from the vending machine.

9. The vending machine of claim 8 in which the burster bar is shaped to create uneven stresses along the zones of weakness when the media units are be pulled against the burster bar.

10. The vending machine of claim 8 in which the burster bar is incorporated into a main guide for feeding the succession of media units through the media dispenser.

11. A vending machine of a type that accepts payments and returns products or services comprising:

an input interface that accepts and processes payments;

an output interface that delivers products or services in return for the payments;

an uninterrupted supply of media arranged in a succession of units separated by zones of weakness;

a media dispenser that dispenses the media units in association with the delivery of the products or services; and a driver within the media dispenser responsive to a registrable feature of the media units for advancing the media units to a dispensing position at which the media units can be manually withdrawn from the vending machine by bursting the zones of weakness, wherein:

the media dispenser includes a detector that detects the registrable feature of the media units.

12. The vending machine of claim 11 in which the registrable feature incorporates a security feature that is not apparent from the visual appearance of the media units.

13. The vending machine of claim 12 in which the security feature includes a pattern of variation detectable by the detector.

14. The vending machine of claim 13 in which the pattern of variation produces a detectable optical variation in at least one of reflectance and spectral content.

15. The vending machine of claim 14 in which the pattern of variation can be interpreted to identify individual media units or groups of media units.

16. The vending machine of claim 14 in which the detector senses variation in infrared radiation reflected from the security feature of the media units.

17. The vending machine of claim 16 in which the security feature is printed with a variable optical response profile.

18. A vending machine of a type that accepts payments and returns products or services comprising:

an input interface that accepts and processes payments;

an output interface that delivers products or services in return for the payments;

an uninterrupted supply of media arranged in a succession of units separated by zones of weakness;

a media dispenser that dispenses the media units in association with the delivery of the products or services;

a driver within the media dispenser responsive to a registrable feature of the media units for advancing the media units to a dispensing position at which the media units can be manually withdrawn from the vending machine by bursting the zones of weakness; and a ratioing counter that dispenses individual ones of the media units in a ratio with the delivery of a number of the products or services.

19. The vending machine of claim 18 in which the ratioing counter is adjustable for changing the ratio between the dispensing of the individual media units and the delivery of the number of products or services.

20. The vending machine of claim 19 in which the ratioing counter includes a random number generator for continuously changing the ratio between the dispensing of the individual media units and the delivery of the number of products or services.

21. The vending machine of claim 20 in which the continuously changing the ratio averages to a prescribed fixed ratio.

22. The vending machine of claim 18 further comprising an indicator for announcing appearances of the media units at the dispensing position.

23. A system for dispensing units of preprinted media in conjunction with the delivery of products or services from a common machine comprising:

an uninterrupted supply of media divided by lines of perforation into a succession of individual media units;

the succession of individual media units being preprinted with contents varying between the individual media units;

the succession of individual units being fan-folded into a stack within the machine;

a feed mechanism engaged with the uninterrupted supply of media for transporting the succession of individual media units from the stack to an opening in the machine;

the feed mechanism being responsive to the delivery of products or services from the machine for sequentially advancing the individual media units into a position projecting through the opening in the machine;

the feed mechanism enabling the projecting individual media units to be manually separated from the remaining succession of media units along the lines of perforation; and a detector that detects a registrable feature of the individual media units and supplies this information to the feed mechanism for advancing the individual media units into the projecting position.

24. The system of claim 23 further comprising a burster bar that is aligned with the lines of perforation at the projecting position for the individual media units.

25. The system of claim 24 in which the burster bar is positioned relative to the opening in the machine so that the media units are pulled against the burster bar when manually separated along the lines of perforation.

26. The system of claim 25 in which the burster bar is shaped to create uneven stresses along the lines of perforation when the media units are pulled against the burster bar.

27. The system of claim 23 in which the individual media units include a printed security feature register having a pattern of variation detectable by the detector.

28. The system of claim 27 in which the pattern of variation involves an optical variation in one of reflectance and spectral content.

29. The system of claim 27 in which the printed security feature is incorporated into the registrable feature.

30. The system of claim 27 in which the detector is sensitive to variations in infrared radiation.

31. A system for dispensing units of preprinted media in conjunction with the delivery of products or services from a common machine comprising:

an uninterrupted supply of media divided by lines of perforation into a succession of individual media units;

the succession of individual media units being preprinted with contents varying between the individual media units;

the succession of individual units being fan-folded into a stack within the machine;

a feed mechanism engaged with the uninterrupted supply of media for transporting the succession of individual media units from the stack to an opening in the machine;

the feed mechanism being responsive to the delivery of products or services from the machine for sequentially advancing the individual media units into a position projecting through the opening in the machine;

the feed mechanism enabling the projecting individual media units to be manually separated from the remaining succession of media units along the lines of perforation; and a ratioing counter that advances the individual media units into the projecting position following the delivery of a number of products or services from the machine.

32. The system of claim 31 in which the ratioing counter is adjustable for changing the ratio between the advancement of the individual media units and the delivery of the number of products or services.

33. The system of claim 32 in which the ratioing counter is adjustable for changing the ratio between the advancement of the individual media units and the delivery of the number of products or services.

34. The system of claim 33 in which the ratioing counter includes a random number generator for continuously changing the ratio between the advancement of the individual media units and the delivery of the number of products or services.

35. The system of claim 31 in which the printed contents of the succession of media units vary from each other in an apparent random fashion.

36. The system of claim 31 in which the media units include media units that are redeemable for products or services.

37. A system for dispensing units of preprinted media in conjunction with the delivery of products or services from a common machine comprising:

an uninterrupted supply of media divided by lines of perforation into a succession of individual media units;

the succession of individual media units being preprinted with contents varying between the individual media units;

the succession of individual units being fan-folded into a stack within the machine;

a feed mechanism engaged with the uninterrupted supply of media for transporting the succession of individual media units from the stack to an opening in the machine;

the feed mechanism being responsive to the delivery of products or services from the machine for sequentially advancing the individual media units into a position projecting through the opening in the machine; and the feed mechanism enabling the protecting individual media units to be manually separated from the remaining succession of media units along the lines of perforation, wherein:

the media units include media units that are redeemable for products or services, and the redeemable media units include redeemable media units that are redeemable for the products or services delivered by the machine.

38. The system of claim 37 in which the printed contents of a plurality of the media units express a common theme.

39. The system of claim 38 in which the common theme is a common cultural theme promoted for purposes of collection.

40. A system for dispensing units of preprinted media in conjunction with the delivery of products or services from a common machine comprising:

an uninterrupted supply of media divided by lines of perforation into a succession of individual media units;

the succession of individual media units being preprinted with contents varying between the individual media units;

the succession of individual units being fan-folded into a stack within the machine;

a feed mechanism engaged with the uninterrupted supply of media for transporting the succession of individual media units from the stack to an opening in the machine;

the feed mechanism being responsive to the delivery of products or services from the machine for sequentially advancing the individual media units into a position projecting through the opening in the machine;

the feed mechanism enabling the protecting individual media units to be manually separated from the remaining succession of media units along the lines of perforation; and the printed contents of a plurality of the media units expressing a common theme that matches a promotional theme expressed remotely of the machine in conjunction with a promotion of the products or services delivered by the machine.

41. A method of promoting sale of products or services from a machine comprising the steps of:

preprinting an uninterrupted supply of media so that printed contents of a plurality of adjacent media units differ from each other;

separating the adjacent media units by zones of weakness;

arranging the uninterrupted supply of preprinted media within the machine as a fan-folded stack with the folds of the fan-folded stack being made along the zones of weakness;

accepting payment for delivery of products or services from the machine;

advancing the uninterrupted supply of media units in association with the delivery of products or services from the fan-folded stack to a dispensing position at which the media units can be manually withdrawn from the machine by bursting the zones of weakness; and creating a range of artwork in connection with a promotion of the products or services, wherein:

the step of preprinting includes preprinting from the range of artwork connected with the promotion, and the range of preprinted artwork includes coupons redeemable for the products or services delivered from the machine.

42. The method of claim 41 in which the range of preprinted artwork includes artwork having an intrinsic value for purposes of collection.

43. The method of claim 41 including a further step of linking the preprinted artwork to an advertising campaign remote from the machine.

44. A method of promoting sale of products or services from a machine comprising the steps of:

preprinting an uninterrupted supply of media so that printed contents of a plurality of adjacent media units differ from each other;

separating the adjacent media units by zones of weakness;

arranging the uninterrupted supply of preprinted media within the machine as a fan-folded stack with the folds of the fan-folded stack being made along the zones of weakness;

accepting payment for delivery of products or services from the machine; and advancing the uninterrupted supply of media units in association with the delivery of products or services from the fan-folded stack to a dispensing position at which the media units can be manually withdrawn from the machine by bursting the zones of weakness, wherein:

the step of preprinting includes preprinting a registration mark and the step of advancing includes detecting the registration mark for identifying the dispensing position at which the media units can be manually withdrawn.

45. The method of claim 44 including further steps of incorporating a security feature in the registration mark and detecting the security feature for verifying authenticity of the uninterrupted supply of media.

46. The method of claim 44 in which the step of detecting includes sensing a pattern of variation in the security feature.

47. A method of promoting sale of products or services from a machine comprising the steps of:

preprinting an uninterrupted supply of media so that printed contents of a plurality of adjacent media units differ from each other;

separating the adjacent media units by zones of weakness;

arranging the uninterrupted supply of preprinted media within the machine as a fan-folded stack with the folds of the fan-folded stack being made along the zones of weakness;

accepting payment for delivery of products or services from the machine;

advancing the uninterrupted supply of media units in association with the delivery of products or services from the fan-folded stack to a dispensing position at which the media units can be manually withdrawn from the machine by bursting the zones of weakness; and relating the step of advancing the uninterrupted supply of media to the delivery of products or services in a ratio.

48. The method of claim 47 including the further step of changing the ratio from one ratio to another.

49. The method of claim 47 including the further step of continuously changing the ratio.

50. A method of promoting sale of products or services from a machine comprising the steps of:

preprinting an uninterrupted supply of media so that printed contents of a plurality of adjacent media units differ from each other;

separating the adjacent media units by zones of weakness;

arranging the uninterrupted supply of preprinted media within the machine as a fan-folded stack with the folds of the fan-folded stack being made along the zones of weakness;

accepting payment for delivery of products or services from the machine;

advancing the uninterrupted supply of media units in association with the delivery of products or services from the fan-folded stack to a dispensing position at which the media units can be manually withdrawn from the machine by bursting the zones of weakness; and announcing appearances of the media units at the dispensing position.

* * * * *